US009344810B2

(12) United States Patent
Okita

(10) Patent No.: US 9,344,810 B2
(45) **Date of Patent: *May 17, 2016**

(54) CONDENSER MICROPHONE

(71) Applicant: KABUSHIKI KAISHA AUDIO-TECHNICA, Machida-shi, Tokyo (JP)

(72) Inventor: Shioto Okita, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/699,636

(22) Filed: Apr. 29, 2015

(65) Prior Publication Data

US 2015/0326980 A1 Nov. 12, 2015

(30) Foreign Application Priority Data

May 12, 2014 (JP) ..... 2014-098703

(51) Int. Cl.

| | |
|---|---|
| ***H04R 25/00*** | (2006.01) |
| ***H04R 23/00*** | (2006.01) |
| *H04R 3/00* | (2006.01) |
| *H04R 1/00* | (2006.01) |
| *H04R 19/04* | (2006.01) |

(52) U.S. Cl.
CPC *H04R 23/00* (2013.01); *H04R 1/00* (2013.01); *H04R 3/00* (2013.01); *H04R 19/04* (2013.01)

(58) Field of Classification Search
CPC ..... H04R 19/04; H04R 29/005; H04R 29/006
USPC ..... 381/111, 113, 174, 355, 356
See application file for complete search history.

(56) References Cited

FOREIGN PATENT DOCUMENTS

JP 5201598 B2 6/2013

*Primary Examiner* — Sunita Joshi
(74) *Attorney, Agent, or Firm* — Manabu Kanesaka

(57) ABSTRACT

Provided is a condenser microphone having a plurality of condenser microphone units connected in series to improve output sensitivity, and simplify a circuit configuration of the condenser microphone. The condenser microphone units are directly connected to each other in series. An audio signal obtained from one condenser microphone unit, excepting a last series-connected condenser microphone unit, is transmitted to an adjacent succeeding condenser microphone unit, and first and second impedance converters each using an active element are connected to first and last series-connected condenser microphone unit. The audio signals obtained from the condenser microphone units are added and output with balance from output terminals of the first and second impedance converters.

5 Claims, 5 Drawing Sheets

CONDENSER MICROPHONE

RELATED APPLICATIONS

The present application is based on, and claims priority from, Japanese Application No. JP2014-098703 filed May 12, 2014, the disclosure of which is hereby incorporated by reference herein in its entirety.

BACKGROUND OF THE INVENTION

1. Field of the Invention

The present invention relates to a condenser microphone configured to have a plurality of condenser microphone units connected in series to improved output sensitivity, and allow balanced output of positive and negative audio signals from the condenser microphone units connected in series.

2. Description of the Related Art

A condenser microphone generates an audio signal based on a change in capacitance between a diaphragm and a fixed electrode which are opposed to each other.

In this configuration, a condenser microphone unit is disposed with the diaphragm opposing to the fixed electrode, and the condenser microphone unit has a capacitance of approximately several ten picofarads, and an output impedance is considerably high. Therefore, the audio signal is extracted using an impedance converter using for example a field effect transistor (FET).

Various devices for improving the output sensitivity of the condenser microphone have been proposed conventionally, a condenser microphone using a plurality of condenser microphone units connected in series to improve output sensitivity has been proposed by an applicant of the present invention, and disclosed in JP 5201598 B2.

FIG. 5 is a block diagram illustrating a configuration of a condenser microphone disclosed in JP 5201598 B2.

The configuration illustrated in FIG. 5 includes first to fourth condenser microphone units U1 to U4, and each of the condenser microphone units U1 to U4 constitutes an electret condenser microphone unit including a dielectric electret film on any of a fixed electrode or diaphragm.

The condenser microphone illustrated in FIG. 5 is configured so that audio signals obtained from the first and second condenser microphone units U1 and U2 are added in series in the same phase, and audio signals obtained from the third and fourth condenser microphone units U3 and U4 are also added in series in the same phase.

That is, a diaphragm 1*a* of the first condenser microphone unit U1 is connected to a ground line as a reference potential point of a circuit, and the fixed electrode 2*a* opposed to the diaphragm 1*a* is connected to a first impedance converter 3*a*. Therefore, the audio signal is generated by the impedance converter 3*a* based on a change in capacitance between the diaphragm 1*a* and the fixed electrode 2*a* of the condenser microphone unit U1.

The audio signal obtained from the first condenser microphone unit U1, generated by the first impedance converter 3*a*, is supplied to the diaphragm 1*b* constituting the second condenser microphone unit U2. The fixed electrode 2*b* opposed to the diaphragm 1*b* is connected to the second impedance converter 3*b*, and the audio signal is generated by the second impedance converter 3*b* based on a change in capacitance between the diaphragm 1*b* and the fixed electrode 2*b* of the condenser microphone unit U2.

In this configuration, the second condenser microphone unit U2 is configured so that the audio signal obtained from the first condenser microphone unit U1 is applied to the diaphragm 1*b*, and audio signals obtained from the first and second condenser microphone units U1 and U2 are added in the same phase and output from an output terminal Out (+) of the second impedance converter 3*b*.

Therefore, the output sensitivity as the condenser microphone can be doubled.

While, the third and fourth condenser microphone units U3 and U4 also include a third impedance converter 3*c* and a fourth impedance converter 3*d*, respectively, and are operated so that audio signals obtained from the third and fourth condenser microphone units U3 and U4 are added in the same phase, similarly to the operation of the first and second condenser microphone units U1 and U2 having been described the above.

However, in the third condenser microphone unit U3, the fixed electrode 2*c* is connected to the ground line, and the diaphragm 1*c* is connected to the third impedance converter 3*c*. Further, output of the third impedance converter 3*c* is supplied to the fixed electrode 2*d* of the fourth condenser microphone unit U4, and the diaphragm 1*d* is connected to the fourth impedance converter 3*d*.

Accordingly, audio signals of opposite phase are output with balance from the output terminal Out (+) of the second impedance converter 3*b* and an output terminal Out (−) of the fourth impedance converter 3*d*.

A condenser microphone disclosed in JP 5201598 B2 includes impedance converters corresponding to the condenser microphone units connected in series as described the above, respectively.

The impedance converters employ active elements such as an FET, respectively. Accordingly, each of the impedance converters requires a circuit configuration for driving the active element, and further requires a configuration for supplying operation power (DC power supply Vcc) for each of the active elements. Therefore, the whole circuit structure of the condenser microphone is complicated, and inevitably results in a high cost.

Further, the operation power supply uses a limited power supply such as a known phantom power supply or a battery, and when a plurality of impedance converters using active elements such as an FET is used, each of the impedance converters requires a drive current. As a result, even if for example the phantom power supply is used, the condenser microphone has such a problem that a drop in voltage of the operation power supply for the impedance converter is increased, a maximum output level of the condenser microphone is also limited, and it is difficult to increase a dynamic range.

Further, In order to obtain the balanced positive and negative audio signals, the condenser microphone unit needs to be divided into two for a positive phase signal and a negative phase signal, and the condenser microphone unit is required to have the same number between the positive phase signal and the negative phase signal. In addition, since the condenser microphone unit is divided into the two for the positive phase signal and the negative phase signal, when a difference is made in overall sensitivity between signal transmission paths each including a plurality of impedance converters, the audio signal is output while having an unbalanced level between the positive phase signal and the negative phase signal, and the quality of the audio signal is inevitably deteriorated.

SUMMARY OF THE INVENTION

The present invention has been made in view of the above-mentioned problems of a conventional condenser microphone, and it is an object of the present invention is to provide a condenser microphone in which the number of impedance converters using active elements provided for condenser microphone units are reduced to simplify a configuration, and from which positive and negative audio signals to be output with balance are extracted without dividing the signal transmission path into two.

In this configuration, it was found that when condenser microphone units are directly connected to each other in series, an audio signal obtained from a preceding condenser microphone unit is added to an audio signal obtained from a succeeding condenser microphone unit and transmitted. Based on the founding, the condenser microphone having a circuit configuration simplified as a whole is intended to be provided.

The condenser microphone according to an embodiment of the present invention has been made to improve the above-mentioned problems. The condenser microphone unit includes a plurality of condenser microphone units each including a fixed electrode and a diaphragm disposed to oppose the fixed electrode; and first and second impedance converters, wherein the fixed electrodes and the diaphragms of the condenser microphone units are connected in series to be added in phase and output audio signals obtained from the condenser microphone units, the condenser microphone units are directly connected to each other in series to transmit an audio signal obtained from one condenser microphone unit, excepting a last condenser microphone unit, to an adjacent succeeding condenser microphone unit, the first and second impedance converters each using an active element are connected to first and last series-connected condenser microphone units, and audio signals obtained from the condenser microphone units are added and output with balance from output terminals of the first and second impedance converters.

In this configuration, each of the condenser microphone units preferably employs an electret condenser microphone unit including a dielectric electret film on any one of the fixed electrode or the diaphragm.

Further, the plurality of condenser microphone units may be odd-numbered.

Further, in a preferable form of the present invention, the first impedance converter is connected to the fixed electrode of the first condenser microphone unit in the plurality of condenser microphone units, the diaphragm of the first condenser microphone unit is directly connected to the fixed electrode of the adjacent succeeding condenser microphone unit in the plurality of condenser microphone units, and the second impedance converter is connected to the diaphragm of the last condenser microphone unit.

Still further, the diaphragms of the plurality of condenser microphone units are preferably disposed on the same plane.

In the condenser microphone according to an embodiment of the present invention, the condenser microphone units are directly connected, excepting the first and second impedance converters connected to the first and last series-connected condenser microphone units, to be sequentially added in phase the audio signals obtained from the condenser microphone units.

The audio signals obtained from the condenser microphone units connected in series are added and output with balance, as audio signals of opposite phase, by the first and second impedance converters. Therefore, a condenser microphone can be provided which has a circuit configuration simplified as a whole, compared with the conventional condenser microphone including the impedance converter using the active element for each of the condenser microphone units.

Further, the audio signals obtained from the plurality of condenser microphone units are added and output with balance by the first and second impedance converters, immediately after obtained from the condenser microphone unit, so that, even if exogenous noise is superposed in a succeeding circuit including the impedance converter, an exogenous noise component is effectively canceled upon obtaining the audio signal output with balance. As a result, the S/N ratio of the condenser microphone is improved.

The balanced positive and negative audio signals are derived, respectively, from the first and second impedance converters connected to the first and last series-connected condenser microphone units, so that two divided paths connected in series are not required to obtain balanced positive and negative audio signals, as described in the conventional condenser microphone, and the condenser microphone can be achieved which includes an arbitrary number, including an odd number, of condenser microphone units.

DESCRIPTION OF THE PREFERRED EMBODIMENTS

A condenser microphone according to an embodiment of the present invention will be described below with reference to the drawings.

It is noted that, in embodiments described below, the same portions or the same functional portions are denoted by the same reference signs, and detailed description thereof will be appropriately omitted.

Figure 1:
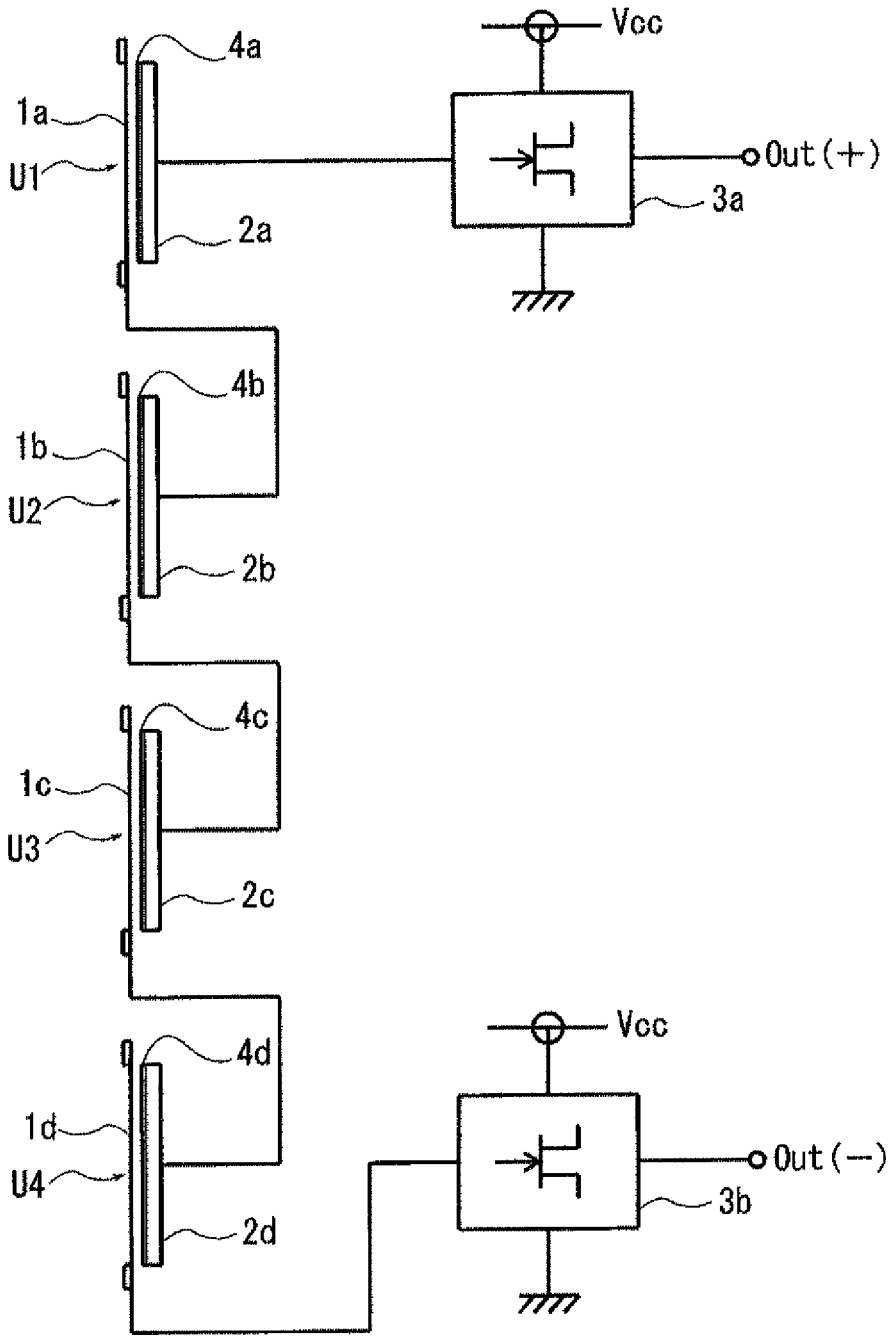
FIG. 1 is a block diagram illustrating a condenser microphone according to a first embodiment of the present invention.

FIG. 1 is a block diagram illustrating the condenser microphone according to a first embodiment, and this embodiment shows an example of balanced output of positive and negative audio signals of opposite phase from the first and fourth condenser microphone units by connecting first to fourth condenser microphone units in series.

As illustrated in FIG. 1, diaphragms 1*a* to 1*d* of the first to fourth condenser microphone units U1 to U4 are disposed on the same plane.

In the embodiment illustrated in FIG. 1, the first to fourth condenser microphone units U1 to U4 have fixed electrodes 2*a* to 2*d* have surfaces opposed to the diaphragms, respectively, and the surfaces are of a back electret type including dielectric electret films 4*a* to 4*d*, respectively.

It is noted that, even if a film electret including the dielectric electret film on the diaphragm side is employed, the same effect as described below is obtained.

As illustrated in FIG. 1, the diaphragm 1*a* of the first condenser microphone unit U1 is connected to the fixed electrode 2*b* of the second condenser microphone unit U2, and the diaphragm 1*b* of the second condenser microphone unit U2 is connected to the fixed electrode 2*c* of the third condenser microphone unit U3. Further, the diaphragm 1*c* of the third condenser microphone unit U3 is connected to the fixed electrode 2*d* of the fourth condenser microphone unit U4.

That is, the first to fourth condenser microphone units U1 to U4 are connected between the fixed electrode 2*a* of the first condenser microphone unit U1 and the diaphragm 1*d* of the fourth condenser microphone unit U4, to directly connect the fixed electrodes and the diaphragms of the condenser microphone units in series, and the audio signals obtained from the condenser microphone units U1 to U4 are added in phase.

As described the above, the audio signals obtained from the condenser microphone units are allowed to be extracted while being added in series in the same phase, without a special impedance converter between the condenser microphone units U1 to U4 connected in series, and this configuration was tested by the inventor.

That is because a space between the diaphragm and the fixed electrode of each of the preceding condenser microphone units U1 to U4 can be considered as a condenser element having a voltage between terminals changing according to an audio waveform. Therefore, it is considered that the audio signals obtained from the condenser microphone units U1 to U4 are added in the same phase and output by an effect equivalent to the series connection of the condenser elements.

The audio signals obtained from the condenser microphone units U1 to U4 are added and output between the fixed electrode 2*a* of the first series-connected condenser microphone unit U1 and the diaphragm 1*d* of a last series-connected condenser microphone unit U4.

This configuration generates voltage values of opposite phase at the fixed electrode 2*a* of the first condenser microphone unit U1, and the diaphragm 1*d* of the last condenser microphone unit U4.

That is, when the diaphragms of the condenser microphone units U1 to U4 are moved together in the same direction upon reception of the audio waveform, voltage between terminals obtained from each of the condenser microphone units U1 to U4, changing based on the audio waveform, is added in series.

A first impedance conversion circuit 3*a* and a second impedance conversion circuit 3*b* each having an input impedance of high value are connected to the fixed electrode 2*a* of the first series-connected condenser microphone unit U1 and the diaphragm 1*d* of a last series-connected condenser microphone unit U4, respectively, and voltage signals of opposite phase (positive and negative) are brought about as the audio signals.

Therefore, according to the above-mentioned configuration illustrated in FIG. 1, the audio signals obtained from the condenser microphone units U1 to U4 are added and output with balance from an output terminal Out (+) of the first impedance conversion circuit 3*a*, and an output terminal Out (−) of the second impedance conversion circuit 3*b*.

Figure 2:
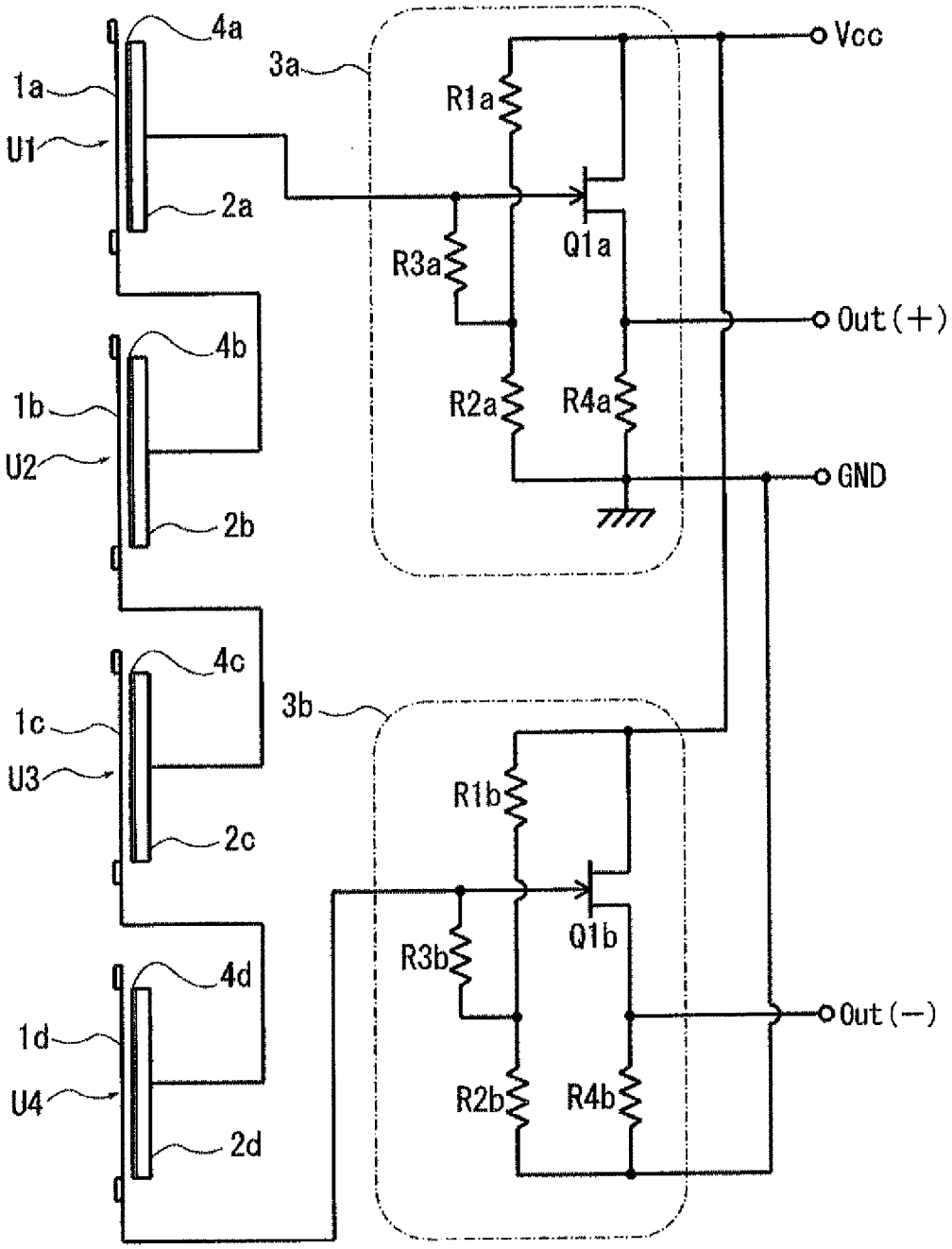
FIG. 2 is a diagram illustrating a specific example of a circuit according to the first embodiment of FIG. 1.

FIG. 2 is a diagram illustrating a specific example of a circuit according to the first embodiment of FIG. 1, and particularly, FIG. 2 illustrates a specific example of the first and second impedance converters 3*a* and 3*b*.

The first impedance converter 3*a* is mounted with an n-channel FET denoted by reference sign Q1*a* which functions as an active element, and the FET Q1*a* has a gate electrode to which the fixed electrode 2*a* of the first condenser microphone unit U1 is connected.

Voltage dividing resistors R1*a* and R2*a* are connected between a DC power supply Vcc and a ground line GND, a bias resistor R3*a* is connected between a connection point between the voltage dividing resistors and the gate electrode, and a predetermined bias voltage is supplied to the gate electrode.

Further power is supplied from the DC power supply Vcc to a drain electrode of the FET Q1*a*, a resistive element R4*a* (source follower resistance) is connected between a source electrode of the FET Q1*a* and the ground line GND, and the source electrode is defined as an output terminal Out (+) for positive phase. That is, the impedance converter 3*a* illustrated in FIG. 2 constitutes a known source follower circuit.

Further, the second impedance converter 3*b* is formed to have the same circuit configuration as the first impedance converter 3*a*, and has circuit elements denoted by the same reference signs as circuit elements of the first impedance converter 3*a*, substituting the trailing "a" with "b". Detailed description thereof will be omitted.

The positive and negative audio signals output with balance from the output terminal Out (+) for positive phase of the first impedance converter 3*a*, and the output terminal Out (−) for negative phase of the second impedance converter 3*b* are supplied to a buffer circuit or the like, not illustrated, receiving an operating current from a well-known phantom power supply mounted to an external device such as a mixer circuit, and supplied to an external device through a balanced shielded cable connected to the buffer circuit.

Figure 3:
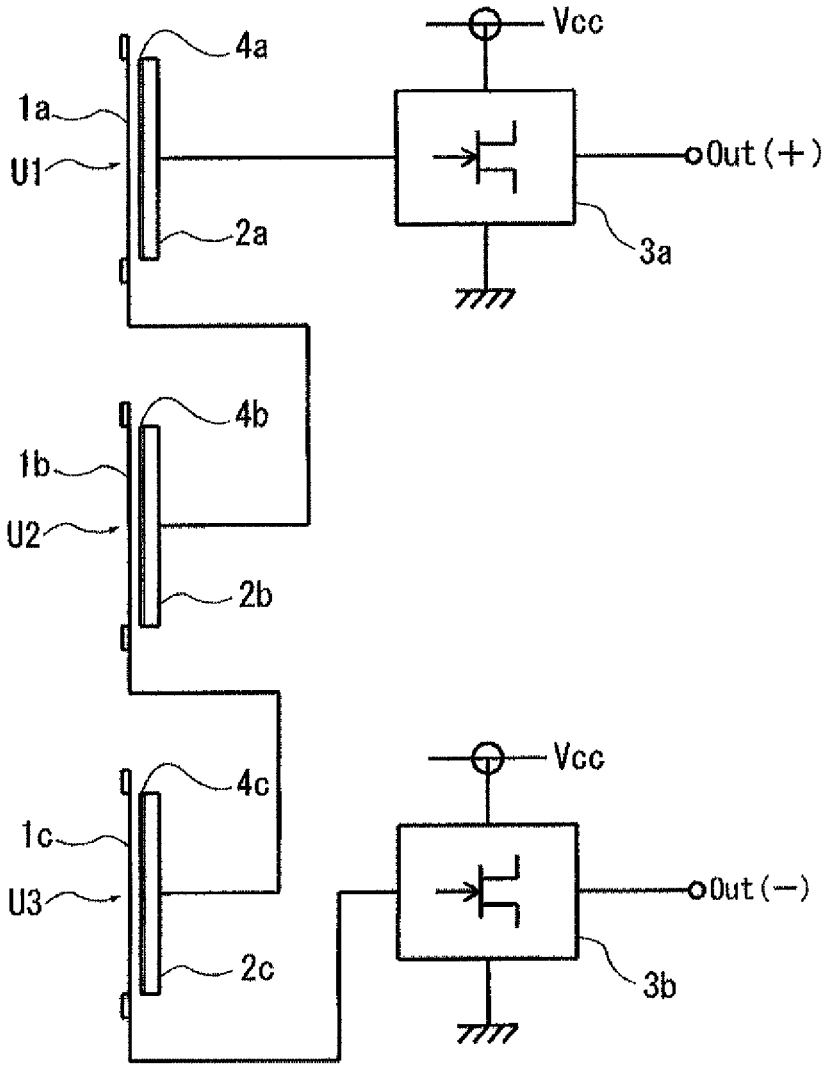
FIG. 3 is a block diagram illustrating a condenser microphone according to a second embodiment of the present invention.
Figure 4:
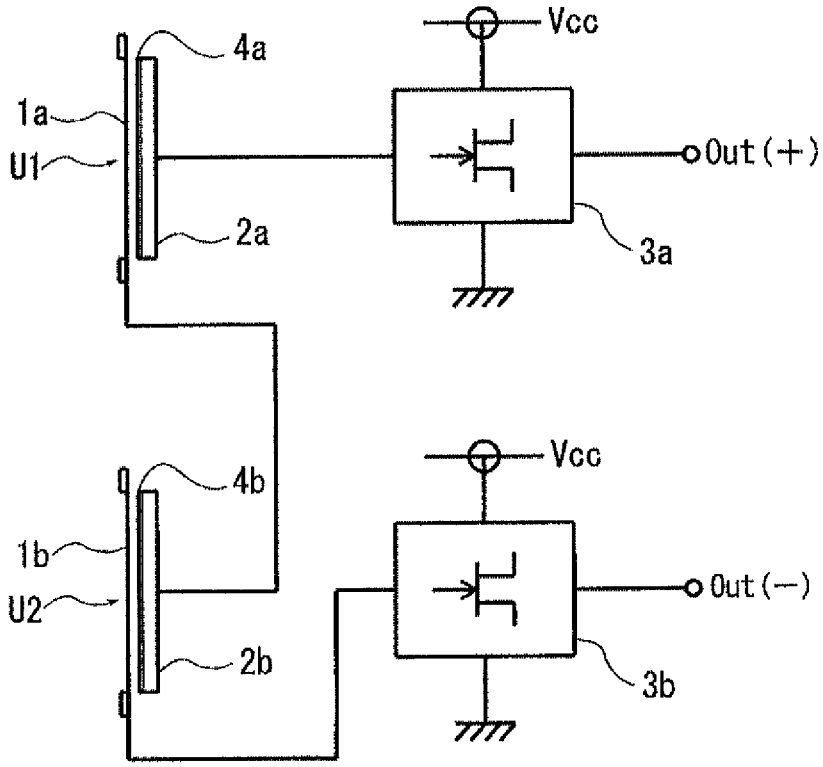
FIG. 4 is a block diagram illustrating a condenser microphone according to a third embodiment of the present invention.

It is noted that the impedance converters 3*a* and 3*b* have a configuration illustrated in FIG. 2, and the configuration can be employed as the impedance converters 3*a* and 3*b* illustrated in FIGS. 3 and 4.

FIG. 3 is a block diagram illustrating the condenser microphone according to a second embodiment. FIG. 3 illustrates an example of series connection of the three condenser microphone units U1 to U3. In the condenser microphone units U1 to U3, the diaphragms 1*a* to 1*c* are disposed on the same plane.

The configuration of FIG. 1 illustrates an example of series connection of the four condenser microphone units U1 to U4, but in this configuration of FIG. 3, the fourth condenser microphone unit is eliminated.

The first impedance converter 3*a* is connected to the fixed electrode 2*a* of the first condenser microphone unit U1, and the second impedance converter 3*b* is connected to the diaphragm 1*c* of the third condenser microphone unit U3.

According to the configuration having been described the above, the audio signals obtained from the first to third condenser microphone units U1 to U3 are added in phase between the fixed electrode 2*a* of the first condenser microphone unit U1 and the diaphragm 1*c* of the third condenser microphone unit U3.

The positive and negative audio signals obtained from the first to third condenser microphone units U1 to U3 are added and output with balance from the output terminal Out (+) of the first impedance conversion circuit 3*a* and the output terminal Out (−) of the second impedance conversion circuit 3*b*.

With the condenser microphone according to an embodiment of the present invention, odd-numbered condenser microphone units U1 to U3 are used for balanced output of the signals added and output as the positive and negative audio signals.

That is, as described in introduction, in this kind of condenser microphone using a plurality of condenser microphone units to improve sensitivity, and outputting positive and negative audio signals with balance, a condenser microphone unit is required to be divided into two for a positive phase and a negative phase, and to have the same number between the positive phase signal and the negative phase signal.

However, with the use of the present invention, the restriction having been described the above can be eliminated, and positive and negative audio signals are output with balance at the same level.

FIG. 4 is a block diagram illustrating a condenser microphone according to a third embodiment. FIG. 4 illustrates an example of balanced output of the positive and negative audio signals by connecting the two condenser microphone units U1 and U2 in series. Similar to the embodiments having been described the above, the diaphragms 1*a* and 1*b* of the two condenser microphone units U1 and U2 are disposed on the same plane.

As illustrated in FIG. 4, the diaphragm 1*a* of the first condenser microphone unit U1 and the fixed electrode 2*b* of the second condenser microphone unit U2 are directly connected. The first impedance converter 3*a* is connected to the fixed electrode 2*a* of the first condenser microphone unit U1, and the second impedance converter 3*b* is connected to the diaphragm 1*b* of the second condenser microphone unit U2.

According to this configuration, the positive and negative audio signals obtained from the first and second condenser microphone units U1 and U2 are added and output with balance from the output terminal Out (+) of the first impedance conversion circuit 3*a* and the output terminal Out (−) of the second impedance conversion circuit 3*b*.

Figure 5:
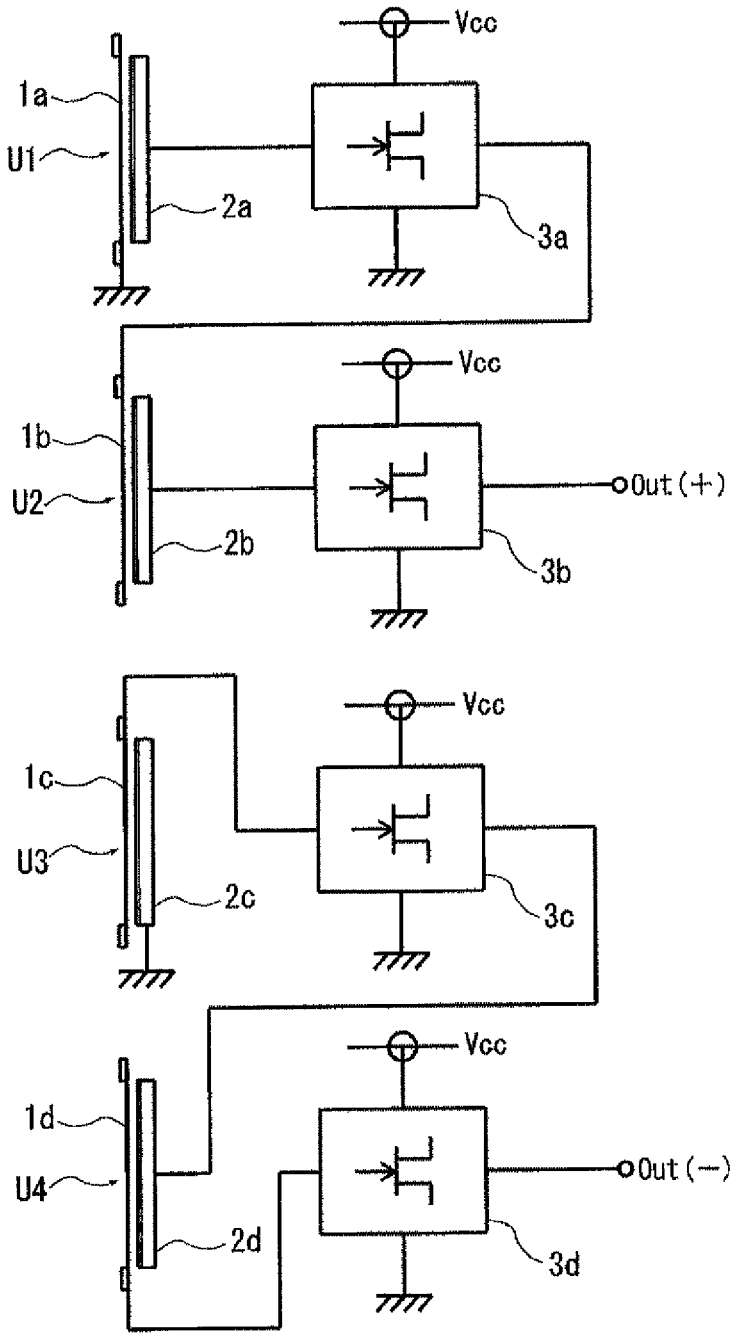
Fig. 5 Prior Art
FIG. 5 is a block diagram illustrating an example of a conventional condenser microphone.

According to the condenser microphone illustrated in FIG. 4, the condenser microphone having an output level equivalent to the conventional balanced output condenser microphone of FIG. 5 including four condenser microphone units can be achieved only by using two condenser microphone units U1 and U2.

Further, with the condenser microphone according to an embodiment of the present invention of FIG. 4, the positive and negative audio signals can be output with balance at the same level. Therefore, in this point, the condenser microphone according to an embodiment of the present invention has a unique effect which cannot be expected from the conventional condenser microphone illustrated in FIG. 5.

As is apparent from the above description, with the condenser microphone according to an embodiment of the present invention, the number of impedance converters each disposed between the condenser microphone units, and each including the active element can be reduced, excepting the first and second impedance converters, and the structure of the condenser microphone can be simplified.

Further, balanced positive and negative audio signals can be extracted without dividing signal transmission path into two, and effectively functions as described in SUMMARY OF THE INVENTION.

What is claimed is:

1. A condenser microphone comprising:

a plurality of condenser microphone units each including a fixed electrode and a diaphragm disposed to oppose the fixed electrode; and first and second impedance converters, wherein the fixed electrodes and the diaphragms of the condenser microphone units are connected in series to be added in phase and output audio signals obtained from the condenser microphone units, the condenser microphone units are directly connected to each other in series to transmit an audio signal obtained from one condenser microphone unit, excepting a last condenser microphone unit, to an adjacent succeeding condenser microphone unit, the first and second impedance converters each using an active element are connected to first and last series-connected condenser microphone units, and audio signals obtained from the condenser microphone units are added and output with balance from output terminals of the first and second impedance converters.

2. The condenser microphone according to claim 1, wherein each of the condenser microphone units is an electret condenser microphone unit including a dielectric electret film on any one of the fixed electrode or the diaphragm.

3. The condenser microphone according to claim 1, wherein the plurality of condenser microphone units are odd-numbered.

4. The condenser microphone according to claim 1, wherein the first impedance converter is connected to the fixed electrode of the first condenser microphone unit in the plurality of condenser microphone units, the diaphragm of the first condenser microphone unit is directly connected to the fixed electrode of the adjacent succeeding condenser microphone unit in the plurality of condenser microphone units, and the second impedance converter is connected to the diaphragm of the last condenser microphone unit.

5. The condenser microphone according to claim 1, wherein the diaphragms of the plurality of condenser microphone units are disposed on the same plane.

* * * * *